US010098445B1

(12) United States Patent
Morad et al.

(10) Patent No.: US 10,098,445 B1
(45) Date of Patent: Oct. 16, 2018

(54) TOILET BOWL CLEANING BRUSH WITH AN INTERCHANGEABLE CLEANING BRUSH HEAD

(71) Applicants: Fred I. Morad, Toluca Lake, CA (US); Robert A. Acosta, Norwalk, CA (US)

(72) Inventors: Fred I. Morad, Toluca Lake, CA (US); Robert A. Acosta, Norwalk, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 0 days.

(21) Appl. No.: 15/876,179

(22) Filed: Jan. 21, 2018

(51) Int. Cl.
*A47K 11/10* (2006.01)
*A46B 5/00* (2006.01)
*B25G 3/24* (2006.01)

(52) U.S. Cl.
CPC ..... *A46B 5/0095* (2013.01); *A47K 11/10* (2013.01); *B25G 3/24* (2013.01); *A46B 2200/304* (2013.01)

(58) Field of Classification Search
CPC . A47K 11/10; A46B 5/0095; A46B 2200/304; B25G 3/24; B25G 3/26
See application file for complete search history.

(56) References Cited

U.S. PATENT DOCUMENTS

| | | | | |
|---|---|---|---|---|
| 7,065,825 | B2 | 6/2006 | Minkler et al. | |
| 7,127,768 | B2 | 10/2006 | Blum et al. | |
| 7,275,276 | B2 | 10/2007 | Jaszenovics et al. | |
| 7,386,910 | B2 | 6/2008 | Minkler et al. | |
| 7,603,739 | B2 | 10/2009 | Minkler et al. | |
| 8,286,295 | B2 | 10/2012 | Minkler et al. | |
| 9,498,879 | B1 * | 11/2016 | Morad | B25G 3/26 |

* cited by examiner

*Primary Examiner* — Laura C Guidotti
(74) *Attorney, Agent, or Firm* — Thomas I. Rozsa

(57) ABSTRACT

An apparatus for an improved toilet bowl cleaner with removable cleaning brush head. The apparatus provides a more simplistic design than previous toilet bowl cleaners with removable brush ends by providing an actuator release button and trigger assembly that functions primarily with a series of rods and springs.

15 Claims, 9 Drawing Sheets

TOILET BOWL CLEANING BRUSH WITH AN INTERCHANGEABLE CLEANING BRUSH HEAD

BACKGROUND OF THE INVENTION

1. Field of the Invention

The present invention relates to field of apparatus used to clean toilet bowls. Specifically, the present invention relates to brushes used to clean toilet bowls.

2. Description the Prior Art

The following six (6) issued patents are the closest prior art known to the inventor:

1. U.S. Pat. No. 7,065,825 issued to Minkler et al. on Jun. 27, 2006 for "Cleaning Tool With Gripping Assembly for a Disposable Scrubbing Head";
2. U.S. Design Pat. No. 7,127,768 issued to Blum et al. on Oct. 31, 2006, for "Disposable Cleaning Head";
3. U.S. Pat. No. 7,275,276 issued to Jaszenovics et al. on Oct. 2, 2007 for "Cleaning Head";
4. U.S. Pat. No. 7,386,910 issued to Minkler et al. on Jun. 17, 2008 for "Cleaning Tool with a Disposable Cleaning Implement";
5. U.S. Pat. No. 7,603,739 issued to Minkler et al. on Oct. 20, 2009 for "Tool for Removal of Faucet Stem and Cartridge"; and
6. U.S. Pat. No. 8,286,295 to Minkler et al. on Oct. 16, 2012 for "Cleaning Tool with a Disposable Cleaning Implement".

SUMMARY OF THE INVENTION

The present invention is an improved toilet bowl cleaning brush with a removable cleaning brush head to allow a user to dispose of a used toilet brush head after use and replace it with a new toilet brush head.

It is an object of the present invention to provide a press fit connection between the toilet brush head and the toilet brush handle to allow a user to replace the brush head after use by releasing the used toilet brush head by sliding a thumb trigger in a forward direction which is a direction away from the proximal end of the handle.

It is also an object of the present invention to provide a more cost effective toilet bowl cleaning brush design by providing parts that are more durable and easily replaceable.

It is an additional object of the present invention to provide a more simplistic design than previous toilet bowl cleaning brushes by facilitating removing used brush heads by providing an actuator release button and trigger assembly that functions primarily with a series of rods and springs. This is an improvement over the prior art by providing a design that does not have parts that are made of plastic that are required to expand and contract during operation. Since plastic parts that expand or bend over time tend to brake after continued use, the present invention is an improvement over the prior art by providing a design that does not require plastic parts to bend or expand during operation.

It is a further object of the present invention to provide an actuator that is retained within a housing to prevent the actuator from releasing a removable toilet cleaning brush from the handle during use.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
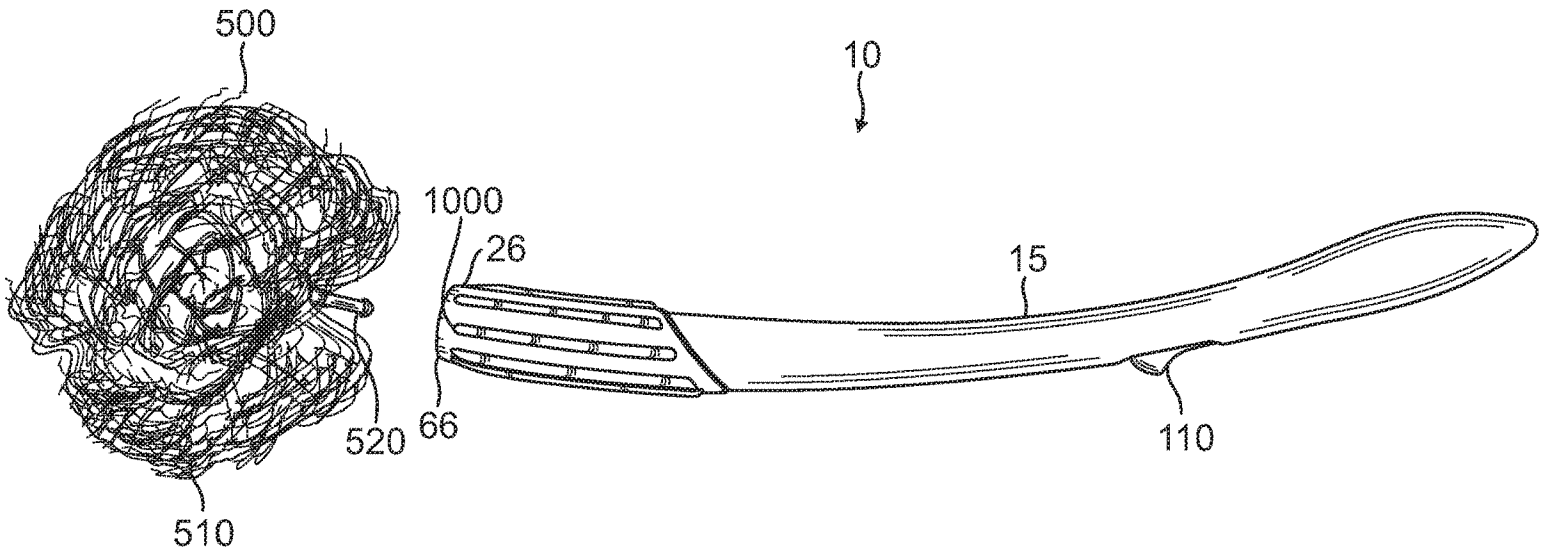
FIG. 1 is a bottom perspective view of the present invention toilet bowl cleaner with interchangeable cleaning attachments.

Referring to FIG. 1, there is illustrated a bottom perspective view of the present invention toilet bowl cleaning brush with an interchangeable cleaning brush head 10 illustrating a curved handle section 15 having a thumb trigger 110 to be used to release an attached cleaning brush head 500 illustrated in the detached condition. Further referring to FIG. 1, the cleaning brush head 500 includes a bristle or padded section 510 used to clean the toilet bowl and a brush locking member 520. Further referring to FIG. 1, there is an interior chamber 1000 that receives the brush locking member 520 that removably retains attached cleaning brush head 500 to curved handle section 15 during use.

Figure 2:
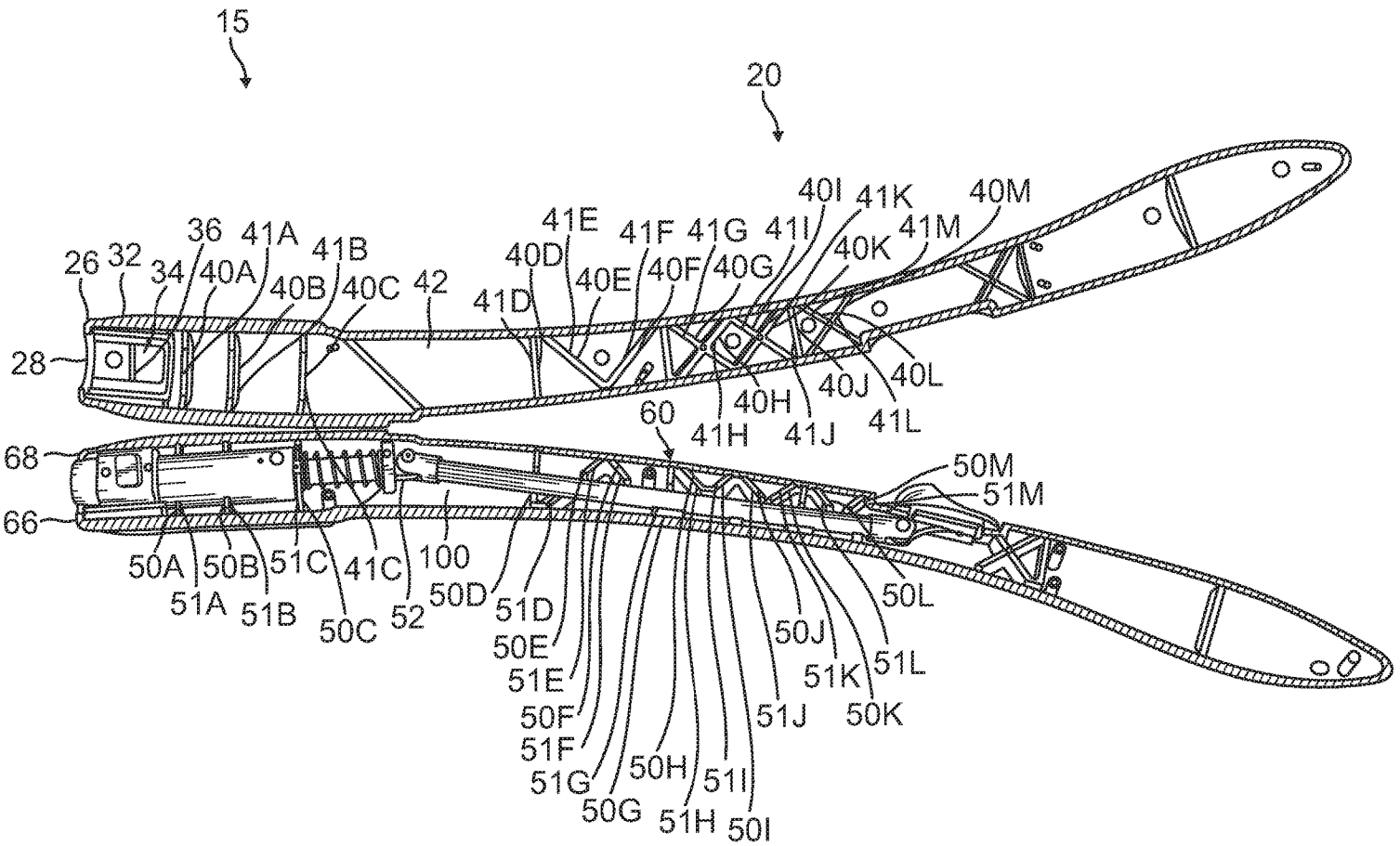
FIG. 2 is an exploded interior view of the handle section of the present invention illustrating the main components of the two sections of the handle in the open condition.
Figure 3:
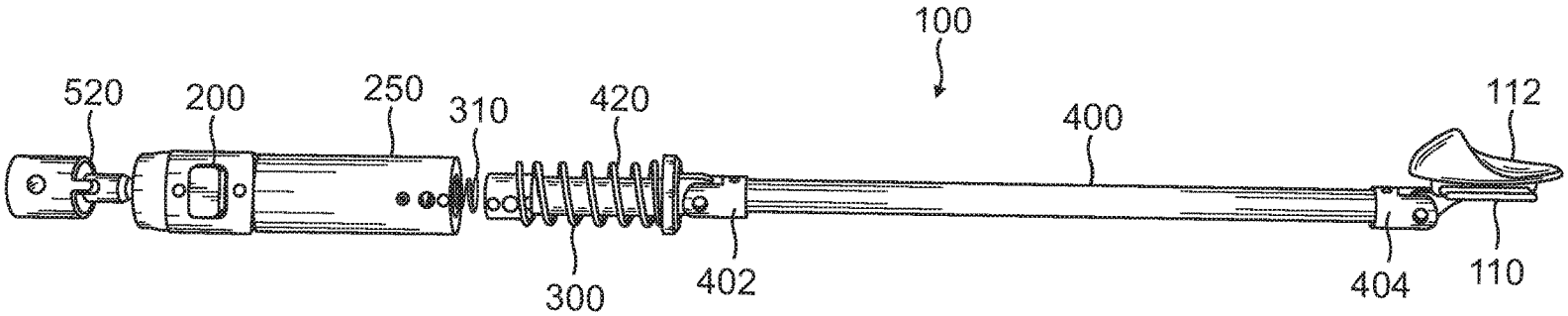
FIG. 3 is an exploded view of the present invention illustrating the trigger assembly removed from the handle.

Referring to FIG. 2, there illustrated an exploded interior view of the handle section 15 in the opened condition of the present invention illustrating the main components of the two sections of the handle in the open condition. The curved handle section 15 in the open condition includes a first mating section 20 and a second mating section 60 that are equally sized to fit together. The first mating section 20 has a first top section 26 having a semi circular shaped end wall 28 surrounding a first top section interior chamber 32. First top section interior chamber 32 includes a first top section end wall 34 with first top section end wall 34 having a wall protruding member 36. Referring to FIG. 3 in addition to FIG. 2, the wall protruding member 36 is sized and located to push actuator 200 when trigger assembly 100 is pushed forward by use of thumb trigger 110 having a thumb surface 112 sized to receive a thumb.

Further referring to FIG. 2, first mating section 20 contains a first top section 26 having a semi circular shaped end wall 28 and a multitude of first interior chambers. Similarly, second mating section 60 contains a second top section 66 having a semi circular shaped end wall 68 and a multitude of second interior chambers. The first interior chambers located in first mating section 20 are separated by first interior chamber walls 40A, 40B, 40C, 40D, 40E, 40F, 40G, 40H, 40I, 40J, 40K, 40L, 40M. Each first interior chamber wall has a respective cutout section 41A, 41B, 41C, 41D, 41E, 41F, 41G, 41H, 41I, 41J, 41K, 41L, and 41M. Together cutout sections 41A, 41B, 41C, 41D, 41E, 41F, 41G, 41H, 41I, 41J, 41K, 41L, and 41M. The first interior chamber sections and respective cutout sections form a first channel 42 that is sized to receive trigger assembly 100 (illustrated removed from second mating section in FIG. 3). Similarly, the second mating section 60 has a multitude of second interior chambers separated by second interior chamber walls 50A, 50B, 50C, 50D, 50E, 50F, 50G, 50H, 50I, 50J, 50K, 50L, and 50M. Each second interior chamber wall has a respective cutout section 51A, 51B, 51C, 51D, 51E, 51F, 51G, 51H, 51I, 51J, 51K, 51L, and 51M. Together, the interior chamber walls with the cutout sections form a second channel 52 that is also sized to receive trigger assembly 100 (illustrated removed from second mating section in FIG. 3).

Referring to FIG. 3, there is illustrated an exploded view of the present invention illustrating the trigger assembly 100 removed from the handle 15. The trigger assembly 100 includes a brush locking member 520 with the bristle or padded section 510 removed. Brush locking member 520 is illustrated in an intermediate condition between being locked inside of actuator housing 250 and being released as illustrated in FIG. 1. FIG. 3 also illustrates release spring 310 that is located inside of actuator housing 250 and travel spring 420 that is wrapped around main push rod 300. Attached by a pin connection 402 to main push rod 300 is travel stem 400 that is connected by pin connection 404 at one end to thumb trigger 110 and main push rod 300 by pin connection 402 at an opposite end.

Figure 4:
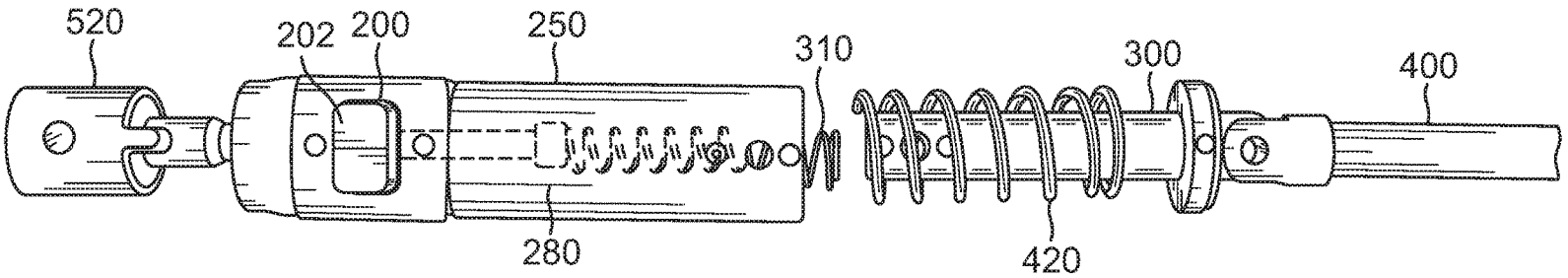
FIG. 4 is a close-up exploded view illustrating components of the trigger assembly taken from a portion of FIG. 3.

Referring to FIG. 4, there is a close-up exploded view illustrating components of the trigger assembly taken from a portion of FIG. 3. Referring again to FIG. 4, there is illustrated a portion of the trigger assembly 100 having a release spring 310 that is located predominantly inside of actuator housing 250 and travel spring 420 that is wrapped around main push rod 300. The main push rod 300 is attached by a first pin connection 402 to a first or proximal end of travel stem 400 that is connected by a second pin connection 404 at a second or distal end to thumb trigger 110. When brush locking member 520 is removably affixed to curved handle section 15, brush locking member 520 may be removed by actuator 200 being pressed. In normal operation when a user desires to release attached cleaning brush head 500 (illustrated in FIG. 1), the user slides thumb trigger 110 forward in a direction closer to attached cleaning brush head 500. The movement of thumb trigger 110 causes the entire trigger assembly 100 consisting of main parts travel stem 400, main pusher rod 300, actuator housing 250, actuator 200, release spring 310, and travel spring 420 to simultaneously move forward. As trigger assembly housing 100 moves forward toward actuator housing 250, actuator angled front surface 202 of actuator 200 is forced inward towards the center of actuator housing 250 when actuator angled front surface 202 comes in to contact with wall protruding member 36 (illustrated in FIG. 2). The pressing of actuator 200, thereby causes brush locking member 520 of attached cleaning brush head 500 to be released from curved handle section 15. The operation of actuator 200 within actuator housing 250 is explained in more detail below.

Referring to FIG. 1, FIG. 2, and FIG. 4, after trigger assembly 100, is moved forward within interior chamber 1000 by use if thumb trigger 110, travel spring 420 is compressed against second interior chamber wall 50C. The potential energy created by the compression of travel spring 420 during the movement of trigger assembly 100 causes trigger assembly 100 to return back to an initial or starting position.

Figure 5:
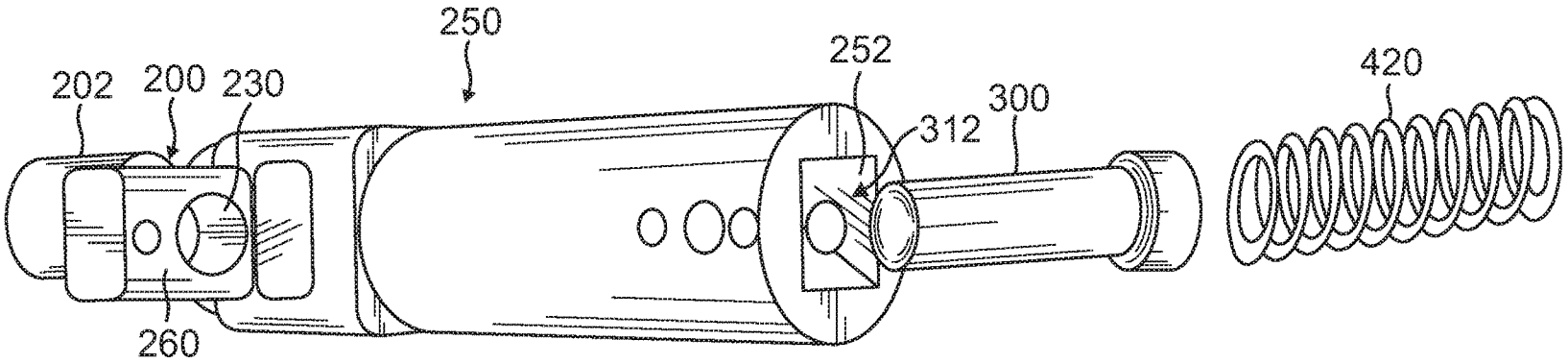
FIG. 5 is a top interior perspective exploded view of the actuator housing illustrating the actuator, the release rod, and release spring removed from the actuator housing.

Referring to FIG. 5, there is illustrated a top interior perspective exploded view of the actuator housing 250 with actuator 200. Release rod 280 and release spring 310 are not illustrated in FIG. 5. FIG. 5 also illustrates actuator 200 having an actuator angled front surface 202, an actuator body 260, and a transverse opening 230. FIG. 5 further illustrates main push rod 300 and travel spring 420 in an exploded view removed from interior chamber 312 of actuator housing 250. The actuator housing 250 has an entrance 252.

Figure 6:
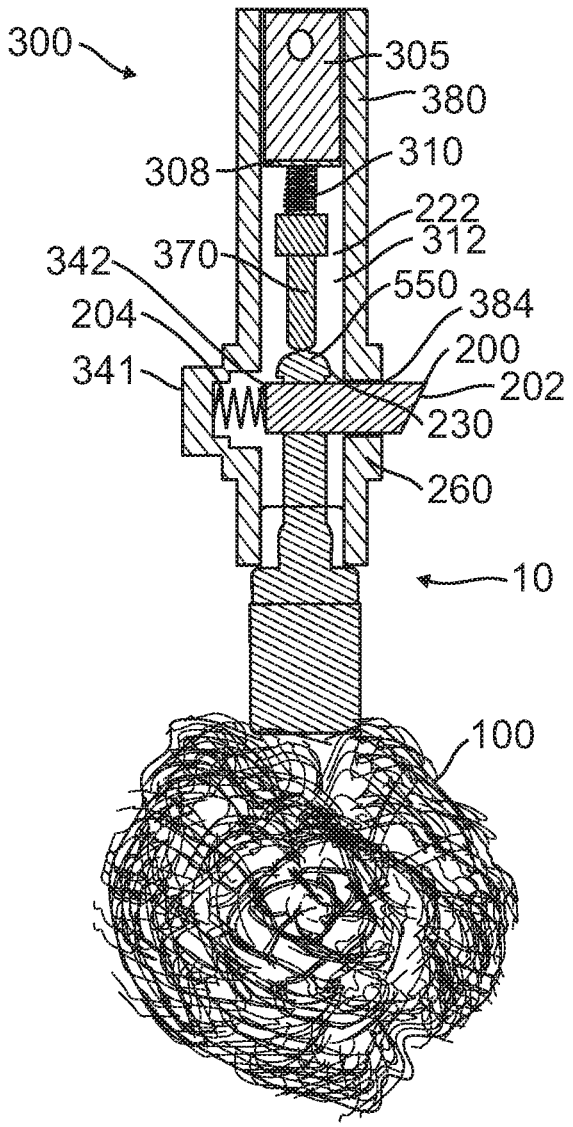
FIG. 6 is a cross sectional view of the actuator housing and brush attachment illustrating the crown of the brush retained within the actuator housing.

Referring to FIG. 6, there is illustrated a cross sectional view of the actuator housing 250 and the actuator release mechanism 390 including the actuator angled front surface 202 affixed to an actuator 200 extending through transverse opening 230 of actuator body 260 of actuator housing 250 surrounded by an interior circumferential wall 223. A transverse actuator spring 204 is retained between a proximal wall 342 of actuator 200 and interior wall 341 of actuator housing 250.

Figure 7:
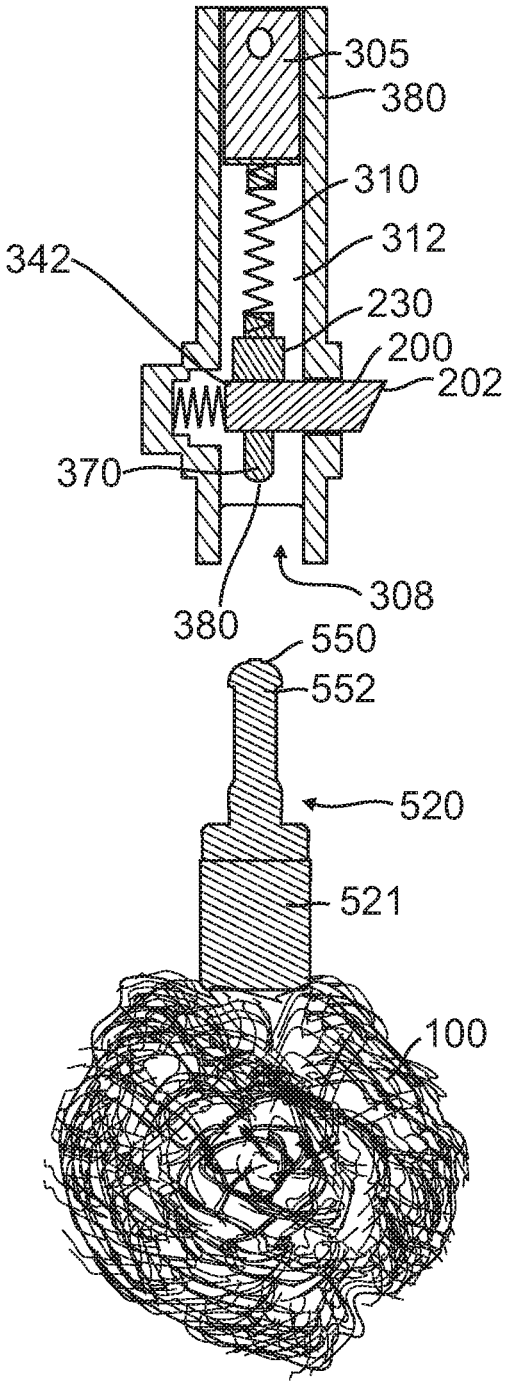
FIG. 7 is a cross sectional and exploded view of the actuator housing and brush attachment illustrating the crown of the brush removed from the actuator housing.

Referring to FIG. 7, there is illustrated a cross sectional and exploded view of the actuator housing 250 and cleaning brush head 500 illustrating brush attachment illustrating the crown 550 of the brush locking member 520.

Referring to FIGS. 6 and 7, the actuator release mechanism 390 will now be described. The actuator release mechanism 390 is retained in actuator housing 250 having exterior wall 380 enclosing interior chamber 312. Within interior chamber 312 is fixed end wall 305 and retaining release spring 310 at one end and the second end of release spring 310 retained by release piston distal end 382 of release piston 370. Initially, the actuator release mechanism 390 is retained partially within interior chamber 312 with actuator angled front surface 202 and a portion of actuator 200 exterior to actuator housing 250 and extending through opening 384 in exterior wall 380. Further referring to FIG. 6 and FIG. 7, there is illustrated is a cross-sectional view illustrating the transverse actuator spring 204 retained between interior wall 341 and proximal end 342 of actuator 200 exerting a transverse force on actuator 200.

Figure 7A:
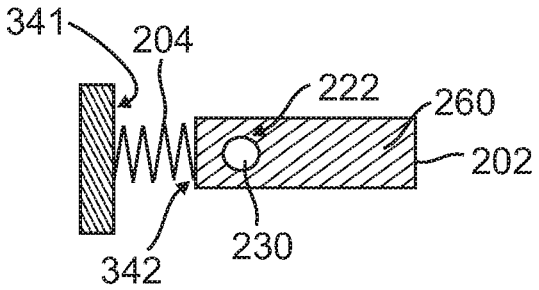
FIG. 7A is a schematic of the actuator body, transverse spring, and crown illustrating the crown of brush attachment not inserted and removed from actuator housing.
Figure 8:
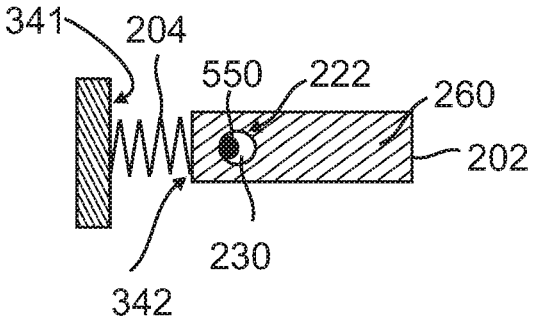
FIG. 8 is a schematic of the actuator body, transverse spring, and crown illustrating the crown of brush attachment retained above the actuator body in the locked position during use of the present invention toilet bowl cleaner with interchangeable cleaning brush.
Figure 9:
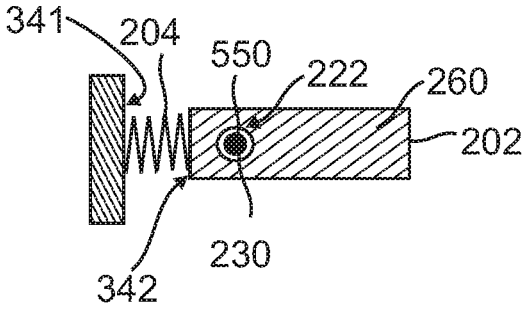
FIG. 9 is a schematic of the actuator body, transverse spring, and crown illustrating the crown of brush attachment aligned with the release piston just prior to the release of attachment brush from the present invention toilet bowl cleaner with interchangeable cleaning attachments.
Figure 10:
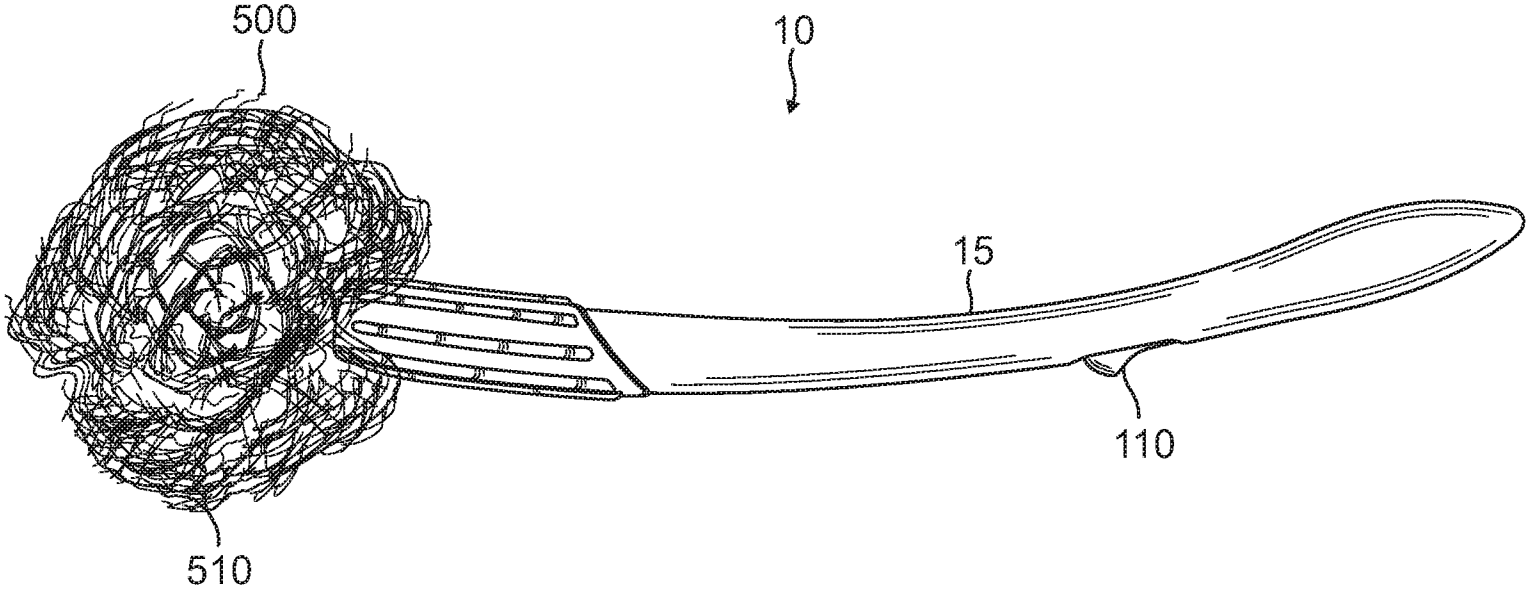
FIG. 10 is a perspective view of the entire assembled toilet bowl cleaning brush with an interchangeable brush head.

In operation, attached locking member 250 of cleaning brush head 500 is inserted through opening 308 in the bottom of actuator housing 250 until crown 550 of brush locking member 520 is moved through and beyond transverse opening 230 in actuator 200. The locking member 520 includes an extension 521 in order to facilitate the locking member being engaged inside the cleaning brush head 500 at one end and facilitating the insertion of the crown 550 into the actuator housing 250. Referring to FIG. 6 and FIG. 7, the transverse actuator spring 204 exerts a transverse force to cause a portion of interior circumferential wall 222 (see FIGS. 7A, 8 and 9) of transverse opening 230 in actuator 200 of actuator release mechanism 390 to retain attached brush locking member 520 under shelf 552 of crown 550 above actuator 200. This is also illustrated by schematic representation in FIG. 8. In this position, crown 550 pushes against release piston 370 to cause release spring 310 to be compressed. To release attached brush locking member 520, a transverse force on actuator 200 causes the transverse actuator spring 204 to be compressed and allow transverse opening 230 within actuator 200 to align with release piston 370 (Illustrated in schematic FIG. 9) and aligned with crown 550 to allow release compression spring 310 to exerts a downward force through release piston 370 against crown 550 causing crown 550 to be forced out of transverse opening 230 and the entire attached brush locking member 520 and cleaning brush head 500 to be pushed out of actuator housing 250 as illustrated in FIG. 7. Further, schematic FIG. 7A illustrates transverse opening 230 prior to the crown 550 of brush locking member 520 being inserted.

To insert a new attached cleaning brush head 500 as illustrated in FIG. 6, crown 550 of attached brush locking member 520 of cleaning brush 500 is forced through transverse opening 230 and retained in housing interior chamber 312 by crown 550 being inserted through transverse opening 230 within actuator 200 and transverse actuator spring 204 forcing proximal end 342 of actuator 200 to move outwardly to cause crown 550 to not be in alignment with transverse opening 230 (illustrated in schematic FIG. 8) and thus retain attached cleaning brush head 500.

The size of the springs disclosed above area as follows: the transverse actuator spring is smaller than the release spring and the release spring is smaller than the travel spring. Transverse opening 230 is not centrally located along actuator body 200.

When the thumb trigger 110 is moved in a forward direction toward actuator 200, this creates a force on actuator angled front surface 202 which pushes actuator 200 to overcome the force of transverse actuator spring and cause the alignment of openings as previously described to cause a decompression or outward pushing force by release spring 310 to release brush locking member 520 and cause the brush locking member 520 and cleaning brush head 500 to be released and ejected out of brush handle 15.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and to show all of the various forms or modifications in which this invention might be embodied or operated.

What is claimed is:

1. An apparatus comprising:

a handle having an exterior section surrounding an interior chamber with an opening at its proximal end leading to the interior chamber configured to retain a trigger assembly;

b. said trigger assembly including a wall protruding member in said exterior section, a release spring located inside an actuator housing and a travel spring surrounding a main push rod, a travel stem connected at a distal end to a thumb trigger and connected at a proximal end to said main push rod, said travel spring keeping said thumb trigger in an un-activated condition;

c. said actuator housing having a release piston, a release spring, and an actuator having an actuator angled front surface at a distal end of its actuator body, the actuator body including an interior circumferential wall with a transverse opening;

d. a removably attached cleaning brush head having a brush locking member including a crown with an under shelf;

e. an opening in said actuator housing aligned with said opening at the proximal end of said exterior section of said handle, an attached cleaning brush head inserted through said opening in the bottom of said actuator housing until said crown is moved through and beyond said transverse opening and a transverse actuator spring exerts a transverse force to cause a portion of said interior circumferential wall of said transverse opening in said actuator body to retain said attached brush locking member under said under shelf in said crown above said actuator body, and a release spring is forced into compression between said crown and a body within the actuator housing; and f. a force on said thumb trigger overcomes the force of said travel spring and the force on said thumb trigger causes said trigger assembly housing to move forward towards said actuator housing, said actuator angled front surface of said actuator is forced inward towards the center of said actuator housing when said actuator angled front surface comes into contact with said wall protruding member through said thumb trigger causing said actuator body to be moved so that the crown is not locked at the under shelf and a force from said release spring forces said brush locking member and the attached cleaning brush head to be ejected from the handle section and the travel spring causes the thumb trigger to return to an initial un-activated position.

2. The apparatus in accordance with claim 1, further comprising: said transverse actuator spring is smaller than said release spring and said release spring is smaller than said travel spring.

3. The apparatus in accordance with claim 1, further comprising: said transverse opening is not centrally located along said actuator body.

4. The apparatus in accordance with claim 1, further comprising: a pin connection connects said main push rod to said travel stem.

5. The apparatus in accordance with claim 1, further comprising: a pin connection connects said travel stem to said thumb trigger.

6. An apparatus comprising:

a curved handle having a first mating section and a second mating section that are equally sized to fit together;

b. said first mating section and said second mating section combined have an opening leading to an interior chamber configured to retain a trigger assembly;

c. said trigger assembly including a wall protruding member in said first top section, a release spring located inside an actuator housing and a travel spring surrounding a main push rod, a travel stem connected at a distal end to a thumb trigger and connected at a proximal end to said main push rod, said travel spring keeping said thumb trigger in an unactivated condition;

d. said actuator housing having a release piston, a release spring, and an actuator having an actuator angled front surface at a distal end of its actuator body, the actuator body including an interior circumferential wall with a transverse opening;

e. a removably attached cleaning brush head having a brush locking member including a crown with an under shelf;

f. said attached cleaning brush head is inserted through an opening in the bottom of said actuator housing until said crown is moved through and beyond said transverse opening and a transverse actuator spring exerts a transverse force to cause a portion of said interior circumferential wall of said transverse opening in said actuator body to retain said attached brush locking member under said under shelf in said crown above said actuator body, and a release spring is forced into compression between said crown and a body within the actuator housing; and g. a force on said thumb trigger overcomes the force of said travel spring and the force on said thumb trigger causes said trigger assembly housing to move forward towards said actuator housing, said actuator angled front surface of said actuator is forced inward towards the center of said actuator housing when said actuator angled front surface comes into contact with said wall protruding member through said thumb trigger causing said actuator body to be moved so that the crown is not locked at the under shelf and a force from said release spring forces said brush locking member and the attached cleaning brush head to be ejected from the handle section and the travel spring causes the thumb trigger to return to an initial un-activated position.

7. The apparatus in accordance with claim 6, further comprising: said transverse actuator spring is smaller than said release spring and said release spring is smaller than said travel spring.

8. The apparatus in accordance with claim 6, further comprising: said transverse opening is not centrally located along said actuator body.

9. The apparatus in accordance with claim 6, further comprising: a pin connection connects said main push rod to said travel stem.

10. The apparatus in accordance with claim 6, further comprising: a pin connection connects said travel stem to said thumb trigger.

11. An apparatus comprising:

a. a curved handle having a first mating section and a second mating section that are equally sized to fit together;

b. said first mating section having a first top section having a semi circular shaped end wall surrounding a first top section interior chamber;

c. said first top section interior chamber containing a first top section end wall and said first top section end wall having a wall protruding member;

d. said second mating section containing a second top section having a semi circular shaped end wall and a multitude of second interior chambers;

e. at least four of said second interior chambers separated by a chamber separator;

f. each first interior chamber wall has a respective cutout section that forms a first channel sized to receive a trigger assembly;

g. each second interior chamber wall has a respective cutout section that forms a second channel sized to receive said trigger assembly;

h. said first channel and said second channel surround said trigger assembly;

i. said trigger assembly having a release spring located inside an actuator housing and a travel spring surrounding a main push rod;

j. a travel stem connected at one end to a thumb trigger and said main push rod at an opposite end, the travel spring exerting a force to prevent activation of said thumb trigger;

k. said actuator housing having a release piston, a release spring, and an actuator having an actuator angled front surface, an actuator body, an interior circumferential wall, and a transverse opening;

l. a removably attached cleaning brush head having a brush locking member including a crown with an under shelf;

m. said attached cleaning brush head is inserted through an opening in the bottom of said actuator housing until said crown is moved through and beyond said transverse opening and a transverse actuator spring exerts a transverse force to cause a portion of said interior circumferential wall of said transverse opening in said actuator body to retain said attached brush locking member under a shelf in said crown above said actuator body, and a release spring is forced into compression between said crown and a body within the actuator housing; and n. a force on said thumb trigger overcomes the force of said travel spring and the force on said thumb trigger causes said trigger assembly housing to move forward towards said actuator housing, said actuator angled front surface of said actuator is forced inward towards the center of said actuator housing when said actuator angled front surface comes into contact with said wall protruding member through said thumb trigger causing said actuator to be moved so that the crown is not locked at the under shelf and a force from said release spring forces said brush locking member and the attached cleaning brush head to be ejected from the handle section and the travel spring causes the thunk trigger to return to an initial un-activated position.

12. The apparatus in accordance with claim 11, further comprising: said transverse actuator spring is smaller than said release spring and said release spring is smaller than said travel spring.

13. The apparatus in accordance with claim 11, further comprising: said transverse opening is not centrally located along actuator body.

14. The apparatus in accordance with claim 11, further comprising: a first pin connection connects said main push rod to said travel stem.

15. The apparatus in accordance with claim 11, further comprising: a second pin connection connects said travel stem to said thumb trigger.

* * * * *